US010907418B2

(12) United States Patent
Ling

(10) Patent No.: US 10,907,418 B2
(45) Date of Patent: Feb. 2, 2021

(54) FORCE SELF-BALANCED DRILL BIT

(71) Applicant: Halliburton Energy Services, Inc., Houston, TX (US)

(72) Inventor: Xianwu Ling, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/319,172

(22) PCT Filed: Jul. 31, 2014

(86) PCT No.: PCT/US2014/049256
§ 371 (c)(1),
(2) Date: Dec. 15, 2016

(87) PCT Pub. No.: WO2016/018394
PCT Pub. Date: Feb. 4, 2016

(65) Prior Publication Data

US 2017/0130533 A1 May 11, 2017

(51) Int. Cl.

| | |
|---|---|
| ***E21B 10/62*** | (2006.01) |
| ***E21B 10/627*** | (2006.01) |
| ***E21B 10/633*** | (2006.01) |
| ***E21B 10/42*** | (2006.01) |

(52) U.S. Cl.
CPC ..... *E21B 10/62* (2013.01); *E21B 10/42* (2013.01); *E21B 10/627* (2013.01); *E21B 10/633* (2013.01)

(58) Field of Classification Search
CPC ..... E21B 10/62; E21B 10/42; E21B 10/573; E21B 10/43
See application file for complete search history.

(56) References Cited

U.S. PATENT DOCUMENTS

| | | | | |
|---|---|---|---|---|
| 1,612,338 | A | 12/1926 | Wilson et al. | |
| 2,740,651 | A | 4/1956 | Ortloff | |
| 4,386,669 | A | 6/1983 | Evans | |
| 4,790,391 | A * | 12/1988 | Hamamura | E21B 4/14 173/198 |
| 4,867,255 | A * | 9/1989 | Baker | E21B 4/20 175/122 |
| 5,361,859 | A | 11/1994 | Tibbitts | |
| 6,142,250 | A | 11/2000 | Griffin et al. | |
| 6,945,338 | B1 | 9/2005 | Defourny et al. | |
| 7,845,430 | B2 | 12/2010 | Johnson et al. | |
| 8,056,651 | B2 | 11/2011 | Turner et al. | |
| 8,061,455 | B2 | 11/2011 | Beuershausen | |

(Continued)

FOREIGN PATENT DOCUMENTS

| | | |
|---|---|---|
| GB | 2294715 A | 5/1996 |
| GB | 2341878 A | 3/2000 |

(Continued)

*Primary Examiner* — David J Bagnell
*Assistant Examiner* — Ronald R Runyan
(74) *Attorney, Agent, or Firm* — Thomas Rooney; Parker Justiss, P.C.

(57) ABSTRACT

An Earth drill bit includes a bit body assembly and a plurality of separately movable cutting elements carried by the bit body assembly. The bit body assembly is arranged around a central bit body axis and includes a hydraulic circuit. The plurality of separately movable cutting elements is movable in a direction parallel to the central bit body axis and supported by fluid in the hydraulic circuit.

17 Claims, 5 Drawing Sheets

(56) References Cited

U.S. PATENT DOCUMENTS

| | | | | |
|---|---|---|---|---|
| 8,205,686 | B2 | 6/2012 | Beuershausen | |
| 2009/0044979 | A1 | 2/2009 | Johnson et al. | |
| 2010/0212964 | A1 | 8/2010 | Beuershausen | |
| 2012/0318580 | A1 | 12/2012 | Oesterberg | |
| 2014/0311801 | A1* | 10/2014 | Jain | E21B 10/62 175/27 |
| 2014/0332271 | A1* | 11/2014 | Do | E21B 10/42 175/57 |

FOREIGN PATENT DOCUMENTS

| | | | |
|---|---|---|---|
| GB | 2423102 | A | 8/2006 |
| GB | 2428713 | A | 2/2007 |
| WO | 2011031696 | A2 | 3/2011 |
| WO | 2016018394 | A1 | 2/2016 |

* cited by examiner

FORCE SELF-BALANCED DRILL BIT

CROSS-REFERENCE TO RELATED APPLICATION

This application is the National Stage of, and therefore claims the benefit of, International Application No. PCT/US2014/049256 filed on Jul. 31, 2014, entitled "FORCE SELF-BALANCED DRILL BIT," which was published in English under International Publication Number WO 2016/018394 on Feb. 4, 2016. The above application is commonly assigned with this National Stage application and is incorporated herein by reference in its entirety.

BACKGROUND

The present disclosure relates to drill bits for drilling a wellbore in a formation, and more particularly to drill bits with movable cutting structures.

A drill bit can be used to drill a wellbore in a formation through rotation of the drill bit about a longitudinal axis. A drill bit generally includes cutting elements (e.g., fixed cutters, milled steel teeth, carbide inserts) on cutting structures (e.g., blades, cones, discs) at a drill end of the drill bit. The cutting elements and cutting structures form a wellbore in a subterranean formation by shearing, crushing, cracking, or a combination of shearing, crushing, and cracking portions of the formation during rotation of the drill bit. Cutting structures at different locations on the same bit are exposed to different loading as they interface with the formation.

DESCRIPTION OF DRAWINGS

Like reference symbols in the various drawings indicate like elements.

DETAILED DESCRIPTION

Figure 1:
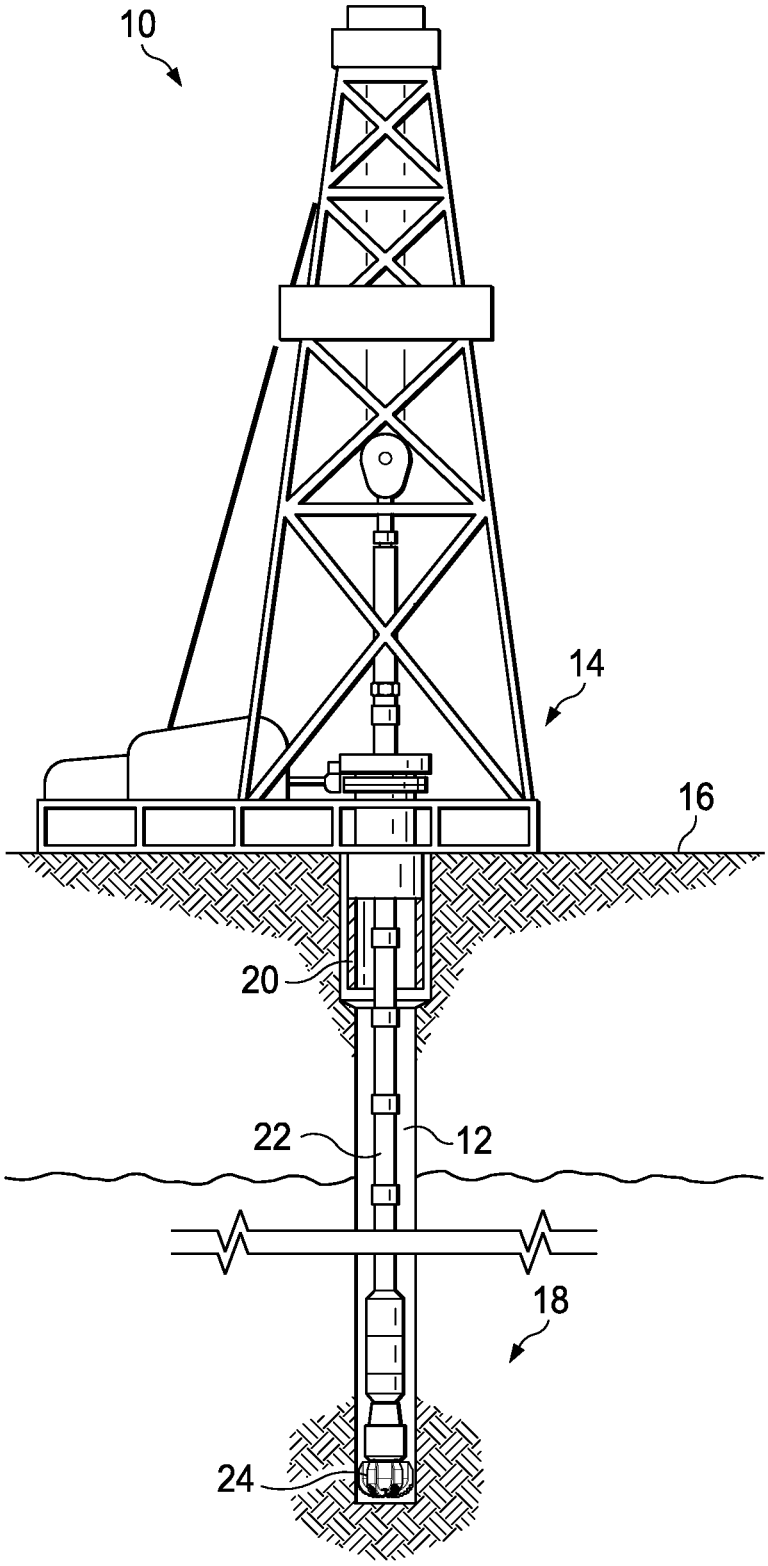
FIG. 1 is a schematic partial cross-sectional view of an example well system.

FIG. 1 is a schematic partial cross-sectional view of an example well system 10 that generally includes a substantially cylindrical wellbore 12 extending from a wellhead 14 at the surface 16 downward into the Earth into one or more subterranean zones of interest (one subterranean zone of interest 18 shown). The subterranean zone 18 can correspond to a single formation, a portion of a formation, or more than one formation accessed by the well system 10, and a given well system 10 can access one, or more than one, subterranean zone 18. After some or all of the wellbore 12 is drilled, a portion of the wellbore 12 extending from the wellhead 14 to the subterranean zone 18 is lined with lengths of tubing, called casing 20. The depicted well system 10 is a vertical well, with the wellbore 12 extending substantially vertically from the surface 16 to the subterranean zone 18. The concepts herein, however, are applicable to many other different configurations of wells, including horizontal, slanted or otherwise deviated wells, and multilateral wells with legs deviating from an entry well.

A drill string 22 is shown as having been lowered from the surface 16 into the wellbore 12. In some instances, the drill string 22 is a series of jointed lengths of tubing coupled together end-to-end and/or a continuous (i.e., not jointed) coiled tubing. The drill string 22 includes one or more well tools, including a bottom hole assembly 24. The bottom hole assembly 24 can include, for example, a drill bit. In the example shown, the wellbore 12 is being drilled. The wellbore 12 can be drilled in stages, and the casing 20 may be installed between stages.

Figure 2:
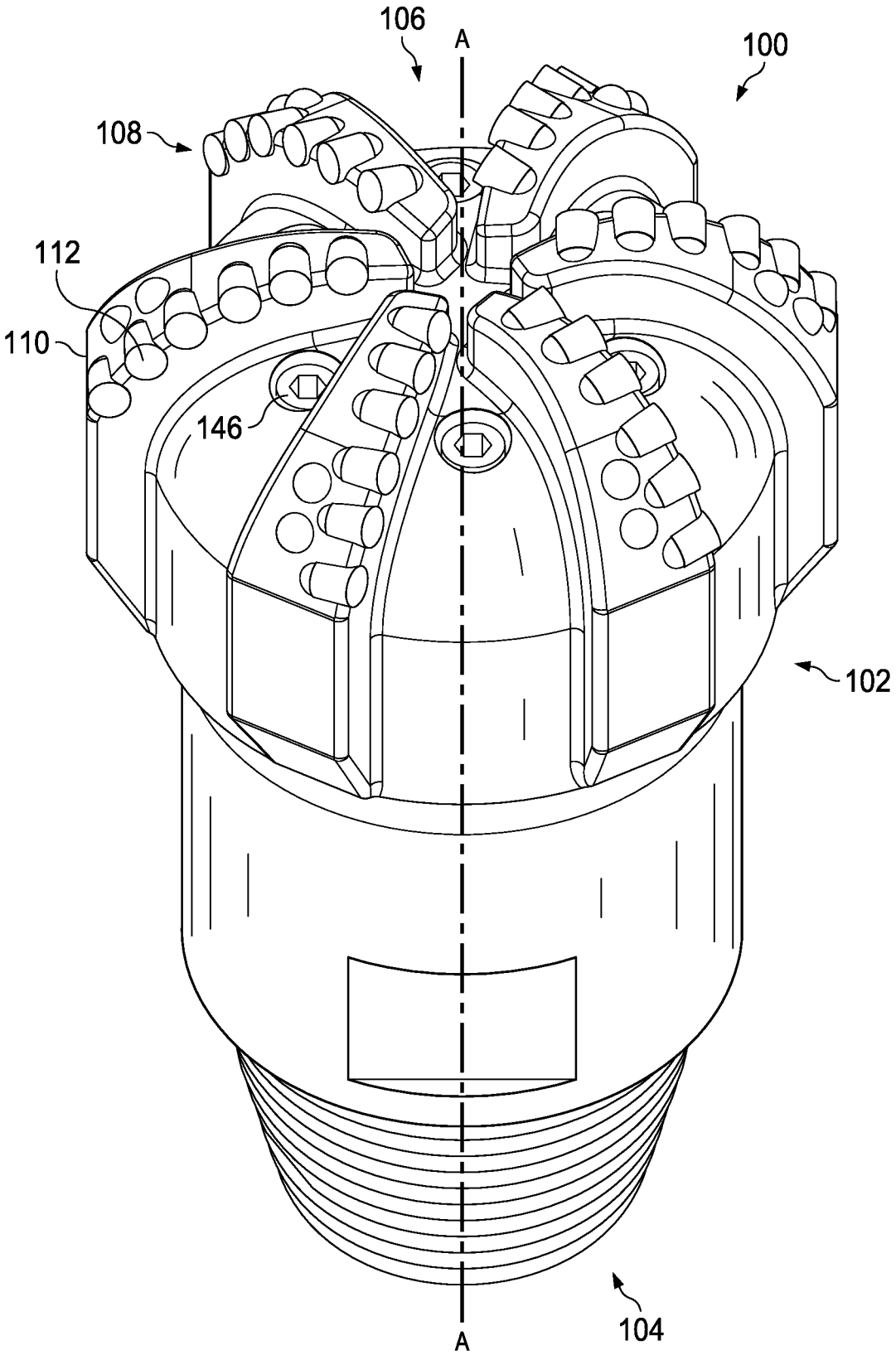
FIG. 2 is a schematic perspective view of an example drill bit.

FIG. 2 is a schematic perspective view of an example drill bit 100 that can be used in the bottom hole assembly 24 of the well system 10 of FIG. 1. The example drill bit 100 includes a bit body assembly 102 with a pin end 104 on one longitudinal end of the bit body assembly 102, a drill end 106 on another longitudinal end of the bit body assembly 102 opposite the pin end 104, and a central bit body axis A-A. The central bit body axis A-A defines a central longitudinal axis through the center of the bit body assembly 102. The drill bit 100 is rotated about the central bit body axis A-A while drilling. In some instances, the pin end 104 is male and is threaded to mate with a female box at a tubing end of a drill string. The bit body assembly 102 includes a hydraulic circuit (as further described below in relation to FIGS. 4A and 4B) within the bit body assembly 102. The example drill bit 100 includes separately movable cutting elements 108 in the form of cutters 112 on blades 110, the separately movable cutting elements 108 carried by the bit body assembly 102, movable (substantially or directly) parallel to the central bit body axis A-A, and supported by fluid in the hydraulic circuit. In the example drill bit 100 of FIG. 2, the cutting elements 108 (i.e., cutters 112 of blades 110) are longitudinally movable along the central bit body axis A-A. The blades 110 extend longitudinally forward from the drill end 106 of the bit body assembly 102 with the cutters 112 partially embedded in the blades 110. Although FIG. 2 depicts the cutting elements 108 as cutters 112 on blades 110, the cutting elements 108 can include additional or different features and components. For example, the cutting elements 108 can include milled teeth, PDC inserts, carbide inserts, and/or other on roller cones, discs, and/or other cutting structures carried by the bit body assembly 102 and supported, or not supported, by the fluid in the hydraulic circuit. The cutting elements 108 are symmetrically arranged on the drill end 106 of the example drill bit 100 about the central bit body axis A-A. In some instances, the cutting elements 108 are not symmetrically arranged on the drill bit 100 about the central bit body axis A-A.

Figure 3A:
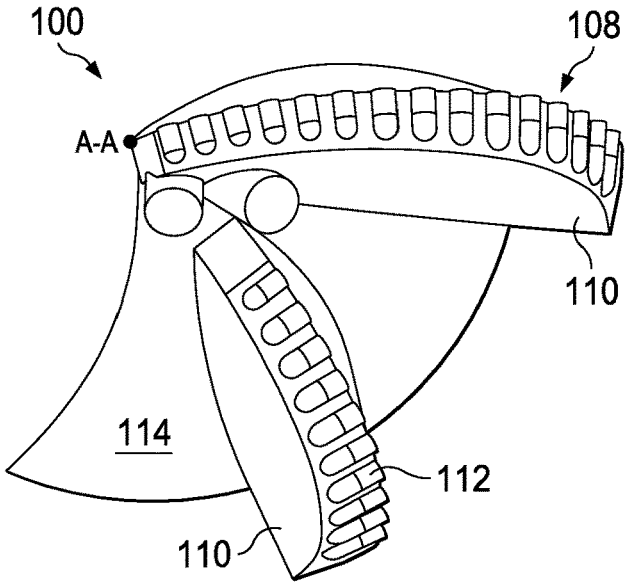
FIG. 3A is a schematic partial end view of an example drill bit.
Figure 3B:
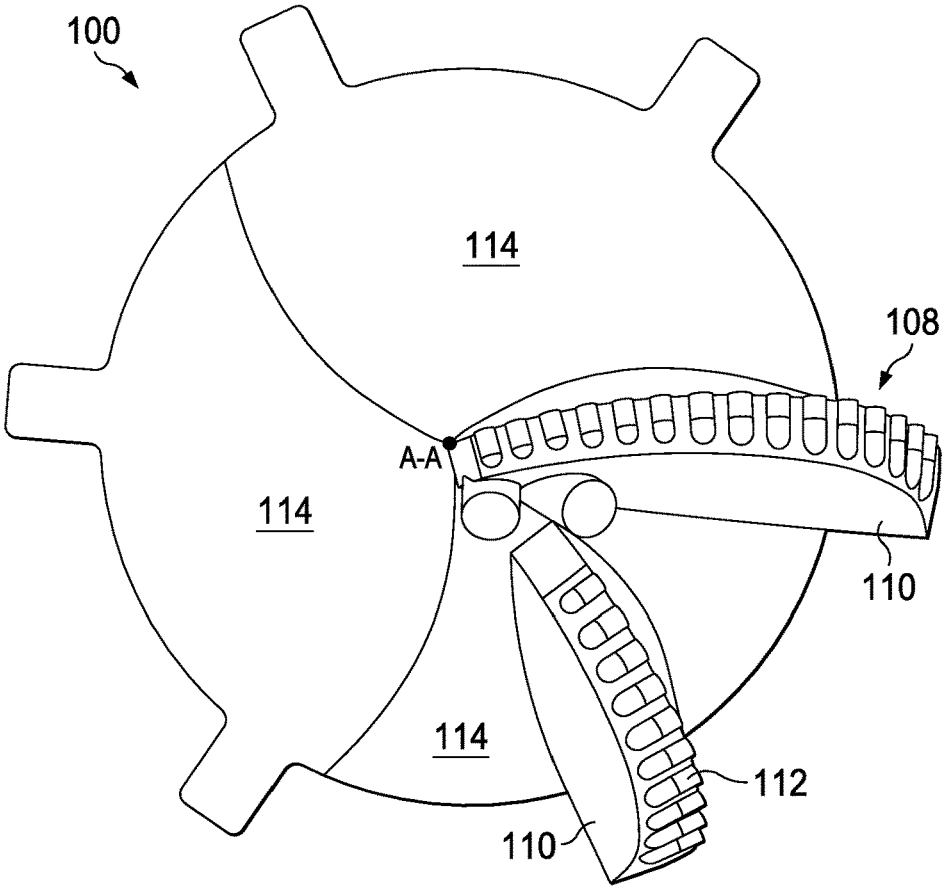
FIG. 3B is a schematic partial end view of an example drill bit.

FIG. 3A is a partial schematic end view of the example drill bit 100, showing cutting elements 108 in the form of the cutters 112 on two blades 110 affixed to a common, moveable petal 114. FIG. 3B shows the cutting elements 108 of FIG. 3A, and outlines a periphery of the example drill bit 100. The periphery shows the example drill bit 100 including three separately moveable petals 114, each with cutting elements 108 in the form of cutters 112 on two blades 110, evenly spaced on the example drill bit 100. In some instances, the number of petals 114 is different, the total number of movable cutting elements 108 provided on the bit 100 is different, the number of cutting structures (e.g., blades 110) carried to move together is different (e.g., one or three or more blades 110 per petal 114), the types of cutting structures are different (e.g., blades 110, roller cones, discs, and/or other cutting structure), and/or the types of cutting elements 108 are different (e.g., milled steel teeth, PDC inserts, carbide inserts, and/or other). For example, the example drill bit 100 can include two or more separately movable petals 114, each having one or more cutting element 108 and/or cutting structure. In some examples, the cutting structures on one or more or each petal include one or more blades, one or more discs, one or more roller cones, and/or a combination of these, where the cutting structures include the cutting elements 108. In certain instances, the cutting structures and/or cutting elements 108 are not evenly spaced on the example drill bit 100.

Figure 4A:
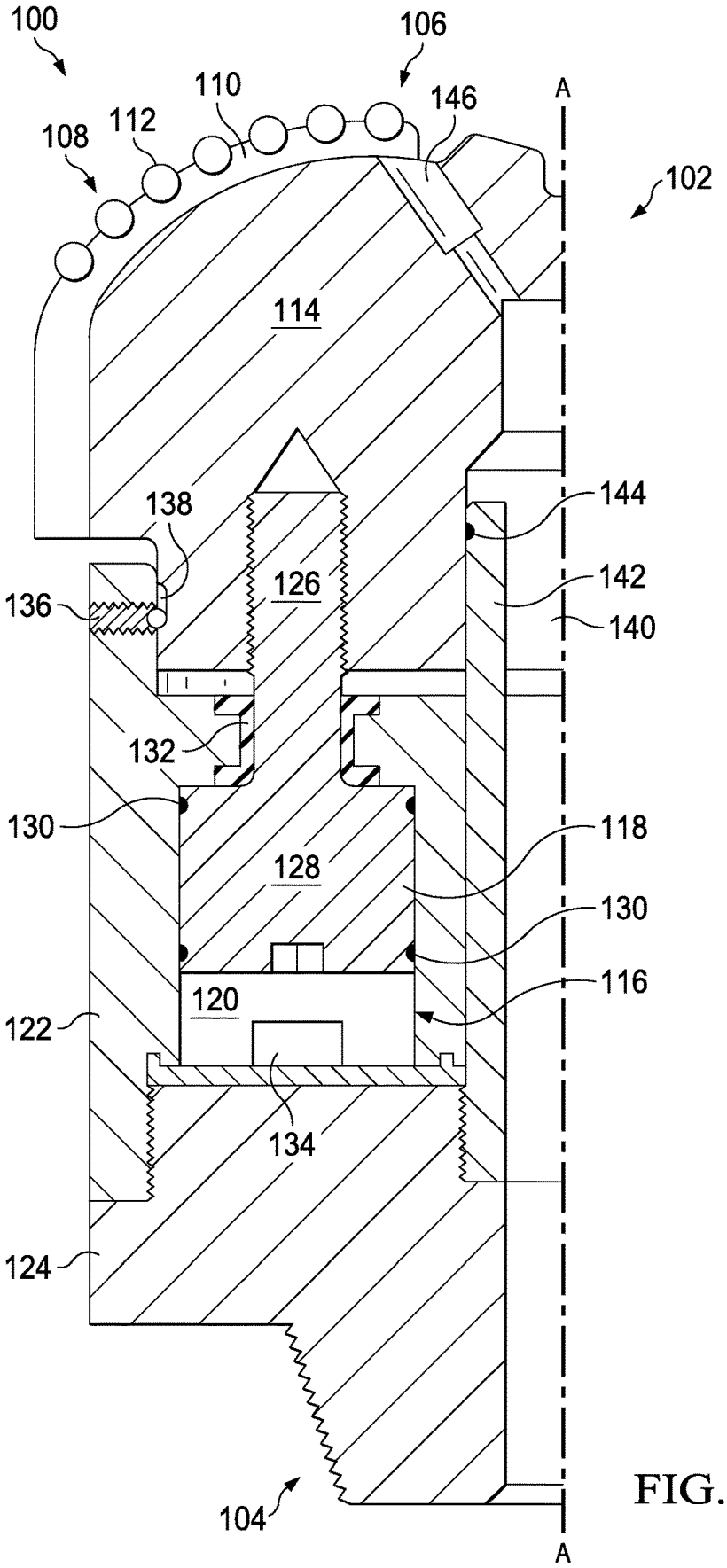
FIGS. 4A and 4B are schematic partial cross-sectional side views of an example drill bit.
Figure 4B:
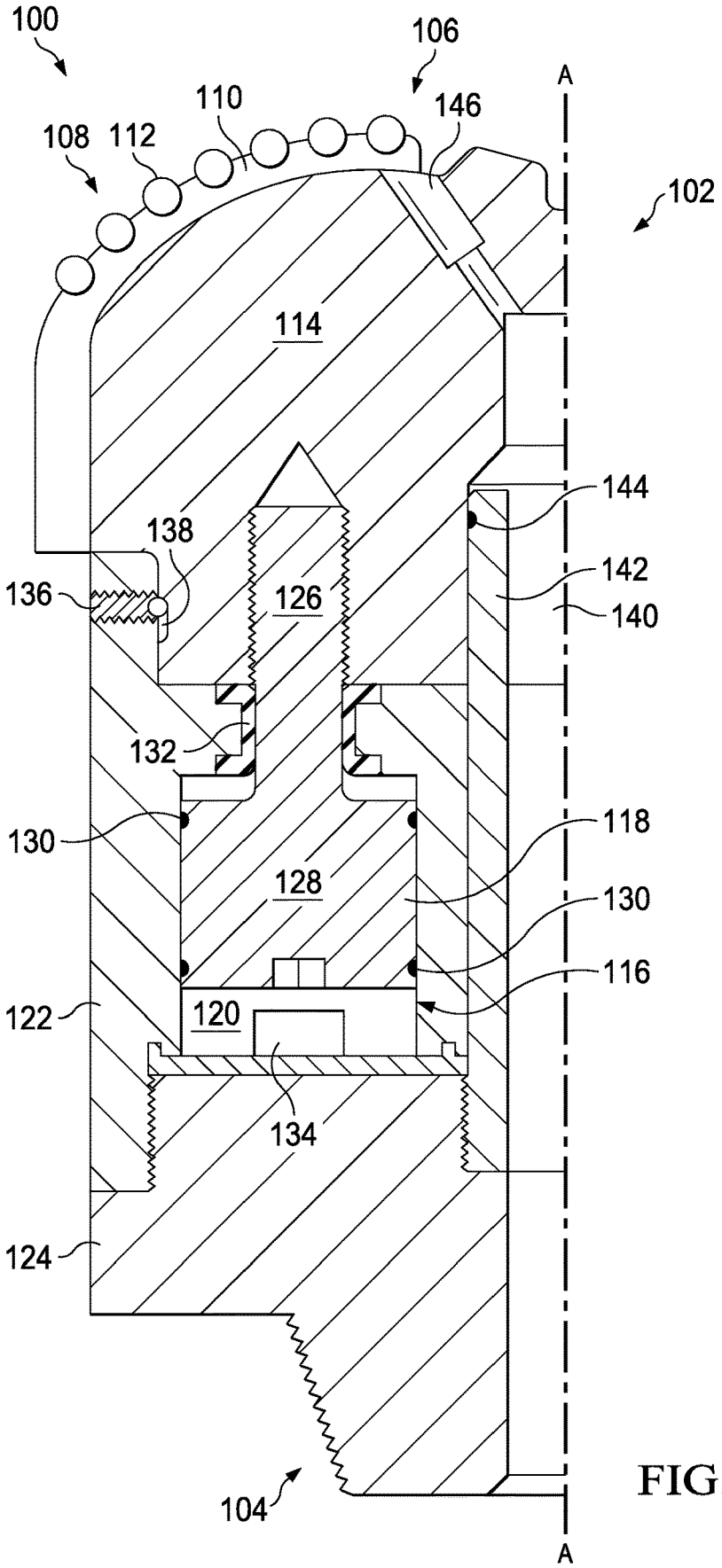

FIGS. 4A and 4B are schematic partial cross-sectional side views of the example drill bit 100 in a first position (FIG. 4A) and a second position (FIG. 4B). The first position of the drill bit 100 shown in FIG. 4A correlates to an axially extended position of the petal 114, and thus cutting element 108. The second position of the drill bit 100 shown in FIG. 4B correlates to an axially compressed position of the petal 114, and thus cutting element 108. The hydraulic circuit 116 includes multiple pistons 118 (one shown) received in hydraulically interconnected cylinders 120 (one shown) defined by an annular petal seat 122 of the bit body assembly 102. A piston 118 and cylinder 120 are provided at each of the petals 114. Thus, the hydraulically interconnected cylinders 120 are circumferentially spaced apart, evenly or unevenly, around the annular petal seat 122. The annular petal seat 122 is affixed to an annular bit body 124 that defines the threaded pin end 104 of the bit body assembly 102. The example drill bit 100 includes multiple petals 114 (one shown), each including a cutting structure (i.e., blade 110) with cutting elements 108 (e.g., cutters 112) and each coupled to a different piston 118. In certain instances, one or more of the petals 114 each connect to more than one piston 118, for example, for redundant support of the petal(s) 114 with the respective pistons 118. Each of the pistons 118 includes a piston pin 126 and a piston body 128. The piston pin 126 couples to (e.g., via threading, adhesive, fasteners, welding, and/or other connection) one of the petals 114. In FIGS. 4A and 4B, the piston pin 126 is cylindrical and partially embeds in the petal 114, extending from the petal 114 into the hydraulically interconnected cylinder 120 of the petal seat 122. The piston body 128 has an outer diameter substantially matching an inner diameter of the hydraulically interconnected cylinder 120. In certain instances, the piston body 128 includes a seal (e.g., o-rings 130) against an inner diameter of the hydraulically interconnected cylinder 120, for example, to resist (substantially or completely) fluid leakage past the piston body 128 of the piston 118. A larger diameter of the piston body 128 relative to the piston pin 126 creates a shoulder region in the petal seat 122 adjacent the hydraulically interconnected cylinder 120. In some instances, the shoulder region of the petal seat 122 acts as a mechanical stop for the petal 114 against the shoulder region (e.g., as depicted in FIG. 4B) and/or as a mechanical stop for the piston body 128 of the piston 118 against the shoulder region (e.g., as depicted in FIG. 4A). In certain instances, the shoulder region of the petal seat 122 acts, in part, to laterally align the petal 114 to the petal seat 122 and to slidably couple the petal 114 to the petal seat 122 for relative longitudinal movement. In some instances, such as depicted in FIGS. 4A and 4B, the shoulder region of the petal seat 122 includes a bushing 132 around a portion of the piston pin 126, for example, to slidably engage with the piston pin 126 during longitudinal movement of the cutting element 108. In some instances, the bushing 132 absorbs rotational and/or lateral vibration of the example drill bit 100 between the petal 114 and the petal seat 122. In certain instances, the bushing 132 includes a material with strong resistance to heat and/or fatigue.

In some instances, the hydraulically interconnected cylinder 120 is a cylindrical chamber that connects to other hydraulically interconnected cylinders in the bit body assembly 102 via channel 134. The channel 134 fluidly connects the hydraulically interconnected cylinders 120 of the bit body assembly such that longitudinal movement of the piston body 128 in the hydraulically interconnected cylinder 120 (e.g., due to the movable cutting element 108 striking a formation) displaces fluid into the hydraulic circuit 116 to act on other pistons in the hydraulic circuit 116. In other words, the hydraulic circuit 116 hydraulically connects and supports two or more petals 114 together such that movement of one petal causes a pressure change against another petal in the same hydraulic circuit via fluid in the hydraulic circuit. For example, during drilling, the example drill bit 100 presses against a formation such that the cutting elements 108 crush, scrape, crack, and/or otherwise engage a formation. In some instances, the formation applies uneven longitudinal pressure on the drill bit 100 such that one of the cutting elements 108 experiences a greater longitudinal pressure than one or more of the other cutting elements 108. The applied pressure can cause a forced translation of the cutting element 108 (i.e., translation of the piston 118), displacing fluid in the hydraulic circuit 116 to each of the other hydraulically interconnected cylinders 120. In some instances, a cutting element moves axially in a direction in response to the cutting element engaging a formation. In response to the axial movement of the cutting element, another cutting element moves axially in an opposing direction, for example, due to displaced fluid in the hydraulic circuit acting against, or pushing, the other cutting element. In other words, moving a cutting element of a cutting structure of the drill bit axially increases fluidic pressure in the hydraulic circuit against another cutting element of another cutting structure to move the other cutting element in the opposing direction. In some examples, a petal with its movable cutting element(s) that engages a strong rock subjects its respective piston to a larger pressure than other pistons in the hydraulic circuit, but the larger pressure is then passed through the fluid in the hydraulic circuit onto the other pistons (i.e., other petals and respective cutting elements) to approach a self-adjusted pressure equilibrium. During drilling of the drill bit 100, the hydraulic circuit 116 can continuously approach pressure equilibrium of the fluid in the hydraulic circuit 116 via fluid transfer through the channel 134 between the hydraulically interconnected cylinders 120, for example, to substantially maintain a uniform pressure on the pistons 118 in the hydraulic circuit 116. The hydraulic circuit 116 allows for self-adjustable force equilibrium among the petals 114 and their respective movable cutting elements 108.

In some instances, the hydraulic circuit 116 balances cutting forces within the example drill bit 100, for example, to better direct the drill bit 100 during drilling and/or reduce eccentricity of a wellbore being drilled. In certain instances, a symmetric arrangement of the cutting elements on the drill bit promotes the self-adjustable force balance of the bit body assembly. In some instances, the bit body assembly 102 reduces drill bit generated vibrations due to unbalanced cutting forces among different cutting structures (e.g., blades, cones, discs, and/or other) or cutting elements 108, for example, due to the self-adjusting capability of the drill bit. In certain instances, the bit body assembly 102 reduces impact damage to the movable cutting elements, which may reduce cutter wear and/or make cutter wear more uniform on a drill bit, for example, due to the self-adjusting capability of the drill bit. In some instances, the bit body assembly 102 suppresses propagations of the drill bit generated high frequency vibrations to a drill string and/or suppresses propagations of drill string generated high frequency vibrations to a drill bit, which may stabilize the drilling process and improve drilling efficiency.

The example drill bit 100 of FIGS. 4A and 4B includes a hydraulic circuit 116 that supports each of the separately movable cutting elements 108 with fluid in the hydraulic circuit 116. In certain instances, the hydraulic circuit 116 supports separately movable cutting elements 108 in a direction non-parallel to the central bit body axis A-A. For example, fluid in a hydraulic circuit of a bit body assembly may support multiple movable cutting elements that move laterally to engage side walls of a wellbore, diagonally with respect to the central bit body axis A-A, and/or in another, different direction non-parallel to the central bit body axis A-A.

In some instances, such as depicted in FIGS. 4A and 4B, the bit body assembly 102 includes a plug 136 in the petal seat 122 that mates with a corresponding longitudinal slot 138 in the petal 114. In some instances, the plug 136 and slot 138 can act to secure the petal 114 to the petal seat 122, for example, when the piston pin 126 of the piston 118 disengages from the petal 114. In certain instances, the slot 138 has a longitudinal length substantially equal to a delta between the first position of the movable cutting element 108 and/or petal 114 (FIG. 4A) and the second position of the movable cutting element 108 and/or petal 114 (FIG. 4B). For example, the plug 136 and slot 138 can act as a mechanical stop, separate from or in addition to the shoulder region of the petal seat 122, to keep the petal 114 at or between the first position (FIG. 4A) and the second position (FIG. 4B). The bit body assembly 102 can include one or more plugs and one or more corresponding slots for each petal 114 of the bit body assembly 102.

In some instances, the example drill bit 100 includes a central bore 140 in the bit body assembly 102 along the central bit body axis A-A, for example, to supply drilling mud to the drill end 106 of the drill bit 100 during drilling. In certain instances, the bit body assembly 102 includes an inner support tube 142 along the central bore 140. The inner support tube 142 couples to the annular bit body 124 and the petal seat 122 and presses against the petals 114. The inner support tube 142 can be coupled to the annular bit body 124 and the petal seat 122 in a variety of ways, for example, with threading, by shrink-fitting the inner support tube 142 in the central bore 140, by welding, and/or in another way. The inner support tube 142 presses against the petals 114, for example, to align, in part, the petals 114 with the petal seat 122 while allowing longitudinal movement of the petals 114 along the inner support tube 142. In certain instances, the inner support tube 142 includes a seal (e.g., o-ring 144) against the petals 114. The inner support tube 142 provides lateral support to the bit body assembly 102, for example, lateral support for the petals 114.

In some instances, such as depicted in FIGS. 2, 4A, and 4B, the bit body assembly 102 includes nozzles 146 at the drill end 106 to provide drilling fluid (i.e., drilling mud) to the formation in front of the drill bit 100 during drilling.

In view of the discussion above, certain aspects encompass an Earth drill bit including a bit body assembly and a plurality of separately movable cutting elements. The bit body assembly is arranged around a central bit body axis and includes a hydraulic circuit. The separately movable cutting elements are carried by the bit body assembly and supported in a direction parallel to the central bit body axis by fluid in the hydraulic circuit.

Certain aspects encompass a method including supporting a plurality of cutting elements of a drill bit on a common hydraulic circuit as the cutting elements cut Earth and, in response to one cutting element moving axially in a direction, moving another cutting element of the drill bit axially in an opposing direction.

Certain aspects encompass a well drill bit including a bit body for attachment to a drill string arranged around a central bit body axis and a plurality of separately movable cutting elements hydraulically supported on a common hydraulic circuit to move relative to the bit body.

The aspects above can include some, none, or all of the following features. The hydraulic circuit includes a plurality of pistons received in hydraulically interconnected cylinders, and the separately movable cutting elements are supported by the pistons and cylinders, each piston and cylinder associated with at least one cutting element. The bit body assembly includes an annular petal seat affixed to an annular bit body, the petal seat defining the plurality of hydraulically interconnected cylinders, each circumferentially spaced apart around the annular petal seat. The bit body assembly includes a plurality of petals each including at least one cutting element and each coupled to a different piston. The drill bit includes an inner support tube in a central bore of the drill bit and against the plurality of petals to laterally support the plurality of petals. The drill bit includes a plug in the petal seat mated with a slot in the petal to movably secure the petal to the petal seat. The drill bit includes at least one cutting structure at each petal, each cutting structure including at least one cutting element of the plurality of separately movable cutting elements. The separately movable cutting elements are symmetrically arranged on the bit body assembly about the central bit body axis. The Earth drill bit includes a plurality of separately movable blades, the blades comprising the cutting elements and supported by fluid in the hydraulic circuit. Moving (e.g., pushing) another cutting element of the drill bit axially in an opposing direction includes increasing fluidic pressure in the hydraulic circuit against the another cutting element to move the another cutting element in the opposing direction. The one cutting element and the other cutting element move in parallel directions. The one cutting element and the other cutting element move in non-parallel directions. The method includes balancing fluidic pressure in the hydraulic circuit against the plurality of cutting elements. The plurality of separately movable cutting elements move parallel to the central bit body axis. The separately movable cutting elements are symmetrically arranged on the bit body about the central bit body axis.

A number of embodiments have been described. Nevertheless, it will be understood that various modifications may be made. Accordingly, other embodiments are within the scope of the following claims.

What is claimed is:

1. An Earth drill bit, comprising:

a bit body assembly arranged around a central bit body axis and comprising a hydraulic circuit; and a plurality of separately movable petals carried by the bit body assembly and supported by fluid in the hydraulic circuit, wherein adjacent side surfaces of the plurality of separately movable petals move along and parallel to each other and in a direction parallel to the central bit body axis; and one or more cutting elements coupled to each of the plurality of separately movable petals.

2. The Earth drill bit of claim 1, where the hydraulic circuit comprises a plurality of pistons received in hydraulically interconnected cylinders; and where the separately movable petals are supported by the pistons and cylinders, each piston and cylinder associated with at least one petal.

3. The Earth drill bit of claim 2, where the bit body assembly comprises:

an annular petal seat affixed to an annular bit body, the petal seat defining the plurality of hydraulically interconnected cylinders, each circumferentially spaced apart around the annular petal seat.

4. The Earth drill bit of claim 3, where the plurality of pistons are configured to move within associated ones of the plurality of hydraulically interconnected cylinders.

5. The Earth drill bit of claim 4, comprising an inner support tube in a central bore of the drill bit and against the plurality of petals to laterally support the plurality of petals.

6. The Earth drill bit of claim 4, wherein each petal seat includes a plug and each petal includes a slot, the plugs and slots configured to movably secure related petals and petal seats.

7. The Earth drill bit of claim 1, where the separately movable petals are symmetrically arranged on the bit body assembly and come together at the central bit body axis.

8. The Earth drill bit of claim 1, wherein each of the one or more cutting elements includes one or more blades having one or more cutters extending therefrom.

9. The Earth drill bit of claim 1, where the adjacent side surfaces of the plurality of separately movable petals are in contact with each other.

10. A method, comprising:

carrying a plurality of separately movable petals about a bit body assembly arranged around a central bit body axis, wherein each of the plurality of separately movable petals is supported by fluid in a hydraulic circuit and has one or more cutting elements coupled thereto and movable parallel to a central bit body axis as the cutting elements cut Earth; and moving one petal axially in a direction parallel with the central bit body axis, and in response thereto another petal moving axially in an opposing direction parallel with the central bit body axis, wherein adjacent side surfaces of the one petal and the another petal move along and parallel to each other.

11. The method of claim 10, where moving another petal axially in an opposing direction comprises increasing fluidic pressure in the hydraulic circuit against the one petal to move the another petal in the opposing direction.

12. The method of claim 10, where the one petal and the another petal move in parallel directions.

13. The method of claim 10, comprising balancing fluidic pressure in the hydraulic circuit against the plurality of cutting elements.

14. The method of claim 10, where the adjacent side surfaces of the plurality of separately movable petals are in contact with each other.

15. A well drill bit, comprising:

a bit body for attachment to a drill string arranged around a central bit body axis; and a plurality of separately movable petals hydraulically supported on a common hydraulic circuit to move relative to the bit body, wherein the plurality of separately movable petals each have one or more cutting elements coupled thereto, and further wherein adjacent side surfaces of the plurality of separately movable petals move along and parallel to each other and in a direction parallel to the central bit body axis.

16. The well drill bit of claim 15, where the separately movable petals are symmetrically arranged on the bit body about the central bit body axis.

17. The well drill bit of claim 15, where the adjacent side surfaces of the plurality of separately movable petals are in contact with each other.

* * * * *